US012202037B2

(12) United States Patent
Yonehara et al.

(10) Patent No.: US 12,202,037 B2
(45) Date of Patent: Jan. 21, 2025

(54) TWIN INJECTION MOLDING MACHINE INCLUDING TWO INJECTION DEVICES

(71) Applicant: THE JAPAN STEEL WORKS, LTD., Tokyo (JP)

(72) Inventors: Yusuke Yonehara, Tokyo (JP); Yutaka Nakagawa, Tokyo (JP); Toshio Toyoshima, Tokyo (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 0 days.

(21) Appl. No.: 17/748,232

(22) Filed: May 19, 2022

(65) Prior Publication Data

US 2022/0371084 A1 Nov. 24, 2022

(30) Foreign Application Priority Data

May 21, 2021 (JP) ..... 2021-085804

(51) Int. Cl.
*B22D 17/20* (2006.01)
*B22D 17/02* (2006.01)

(52) U.S. Cl.
CPC ..... *B22D 17/2053* (2013.01); *B22D 17/02* (2013.01); *B22D 17/203* (2013.01)

(58) Field of Classification Search
CPC ..... B22D 17/203; B22D 17/2053; B22D 17/2061
See application file for complete search history.

(56) References Cited

U.S. PATENT DOCUMENTS 4,005,167 A * 1/1977 Stern ..... B29C 45/47 264/328.17
4,699,581 A * 10/1987 Nagasaka ..... B29C 45/5008 425/574
5,183,621 A 2/1993 Yukihiro et al.
5,219,586 A 6/1993 Yukihiro et al.
5,735,333 A 4/1998 Nagawa
(Continued)

FOREIGN PATENT DOCUMENTS

CN 106003567 A * 10/2016 ..... B29C 45/0408
JP 2-72914 A 3/1990
(Continued)

OTHER PUBLICATIONS

Communication issued on Sep. 27, 2024 by the Japan Patent Office for Japanese Patent Application No. 2021-085804.

*Primary Examiner* — Kevin E Yoon
*Assistant Examiner* — Jack Yuen
(74) *Attorney, Agent, or Firm* — Sughrue Mion, PLLC

(57) ABSTRACT

A twin injection molding machine includes: a mold clamping device configured to clamp a mold; and first and second injection devices each including: a heating cylinder; a screw disposed in the heating cylinder; and a screw driving device including driving system components and configured to drive the screw. The first and second injection devices are disposed symmetrically with respect to a machine center line of the mold clamping device. The driving system components provided in the screw driving device of the first injection device and the driving system components provided in the screw driving device of the second injection device are each disposed on a side away from the machine center line in the respective screw driving devices.

10 Claims, 7 Drawing Sheets

(56) References Cited

U.S. PATENT DOCUMENTS

| | | | | |
|---|---|---|---|---|
| 6,257,859 | B1 * | 7/2001 | Koda | B29C 45/82 425/149 |
| 6,354,829 | B1 * | 3/2002 | Koide | B29C 45/1761 425/557 |
| 7,131,835 | B2 * | 11/2006 | Okazaki | B29C 45/1777 425/570 |
| 2005/0053685 | A1 * | 3/2005 | Nagaya | B29C 45/1777 425/149 |
| 2017/0291335 | A1 * | 10/2017 | Chen | B29C 45/164 |
| 2022/0097271 | A1 * | 3/2022 | Ogihara | B29C 45/1761 |

FOREIGN PATENT DOCUMENTS

| | | | | |
|---|---|---|---|---|
| JP | 8-318358 | A | 12/1996 | |
| JP | 2001-225345 | A | 8/2001 | |
| JP | 2003-266472 | A | 9/2003 | |
| JP | 2007-111897 | A | 5/2007 | |
| JP | 6636119 | B1 * | 1/2020 | B22D 17/2015 |

* cited by examiner

TWIN INJECTION MOLDING MACHINE INCLUDING TWO INJECTION DEVICES

CROSS-REFERENCE TO RELATED APPLICATIONS

This application is based on and claims priority under 35 USC 119 from Japanese Patent Application No. 2021-085804 filed on May 21, 2021, the contents of which are incorporated herein by reference.

TECHNICAL FIELD

The present disclosure relates to a twin injection molding machine in which two injection devices are provided for a mold clamping device.

BACKGROUND

An injection molding machine includes a mold clamping device for clamping a mold and an injection device for injecting an injection material. When a large molding product is molded, it is necessary to increase a size of the injection device in order to inject a large amount of injection material. However, there is a limit to an increase in size of the injection device. On the other hand, for example, a twin injection molding machine in which two injection devices are provided for one mold clamping device as described in JP H02-72914 A is suitable for molding a large molding product. This is because an injection amount can be shared by the two injection devices.

SUMMARY

The twin injection molding machine is provided with two injection devices. Thus, the twin injection molding machine requires a lateral width corresponding to widths of the two injection devices, and there is a problem in that an installation area increases.

Illustrative aspects of the present disclosure provide a twin injection molding machine which prevents or reduces an increase in lateral width and prevents or reduces an increase in installation area.

Other problems and novel features will become apparent from the description of this specification and the accompanying drawings.

A twin injection molding machine includes one mold clamping device and first and second injection devices. Then, the first and second injection devices each include a heating cylinder, a screw in the heating cylinder, and a screw driving device configured to drive the screw. The present disclosure has an arrangement in which the first and second injection devices are disposed symmetrically with respect to a machine center line of the mold clamping device. Then, driving system components such as a hydraulic accumulator and an electric motor provided in the screw driving device of the first injection device and driving system components provided in the screw driving device of the second injection device are both disposed on a side away from the machine center line in the respective screw driving devices.

According to the present disclosure, the increase in lateral width of the twin injection molding machine can be prevented, and the increase in installation area can be prevented.

DETAILED DESCRIPTION

Hereinafter, illustrative embodiments will be described in detail with reference to the drawings. However, the present invention is not limited to the following illustrative embodiments. In order to clarify the description, the following description and the drawings are simplified as appropriate. In all the drawings, the same elements are denoted by the same reference signs, and repetitive descriptions thereof are omitted. In addition, hatching may be omitted to avoid complicating the drawings.

{Twin Injection Molding Machine According to Present Illustrative Embodiment}

Figure 1:
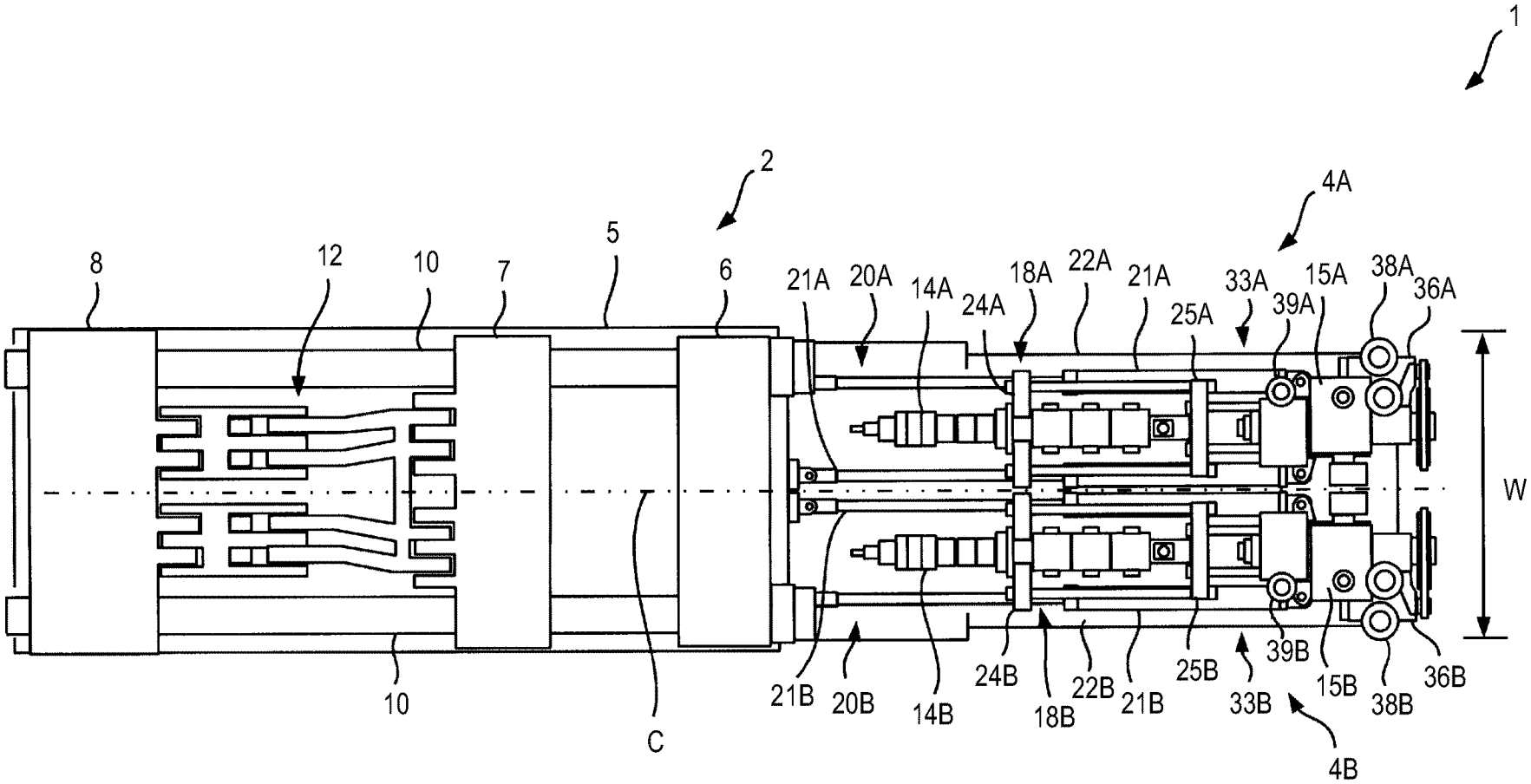
FIG. 1 is a top view showing a twin injection molding machine according to the present illustrative embodiment.

As shown in FIG. 1, a twin injection molding machine 1 according to the present illustrative embodiment includes one mold clamping device 2 and first and second injection devices 4A, 4B. The first and second injection devices 4A, 4B have various features, which will be described in detail later. By some of these features, lateral widths of the first and second injection devices 4A, 4B are controlled to be small. In the present illustrative embodiment, the first and second injection devices 4A, 4B are disposed in parallel, and are positioned symmetrically with respect to a machine center line C of the mold clamping device 2. Since the respective lateral widths are controlled to be small, a lateral width W of the twin injection molding machine 1 is also controlled to be small, and an increase in installation area is prevented.

The twin injection molding machine 1 according to the present illustrative embodiment is a so-called metal injection molding machine that melts and injects a metal. However, various features of the first and second injection devices 4A, 4B to be described later are not limited to injection devices that inject a metal. That is, the present disclosure can be similarly applied to a twin injection molding machine including two injection devices that inject a resin.

{Mold Clamping Device}

The mold clamping device 2 includes a fixed platen 6 fixed to a bed 5, a movable platen 7 provided slidably on the bed 5, and a mold clamping housing 8 provided slidably on the bed 5. The fixed platen 6 and the mold clamping housing 8 are connected by a plurality of tie bars 10, and the movable platen 7 is slidably disposed between the fixed platen 6 and the mold clamping housing 8. A toggle mechanism 12 is provided between the mold clamping housing 8 and the movable platen 7. When a driving system component (not shown), for example, a mold clamping motor is driven to bend and stretch the toggle mechanism 12, the movable platen 7 slides to open and close the mold.

{Bed of Injection Device}

Figure 2:
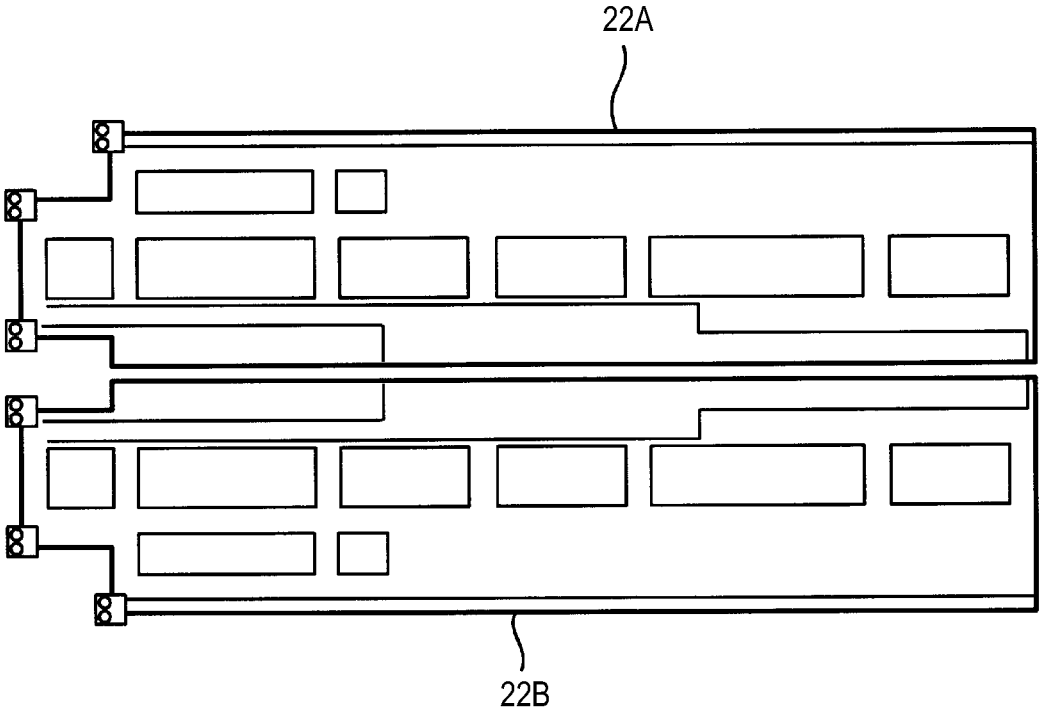
FIG. 2 is a top view showing a bed on which first and second injection devices of the twin injection molding machine according to the present illustrative embodiment are mounted.

In the present illustrative embodiment, the first and second injection devices 4A, 4B are respectively mounted on beds 22A, 22B shown in FIG. 2. The beds 22A, 22B are separable from each other. The twin injection molding machine 1 shown in FIG. 1 includes the mold clamping device 2 mounted on the bed 5, the first injection device 4A mounted on the bed 22A, and the second injection device 4B mounted on the bed 22B, and these parts can be separated and transported separately from a factory to a customer.

{Injection Device}

Figure 3:
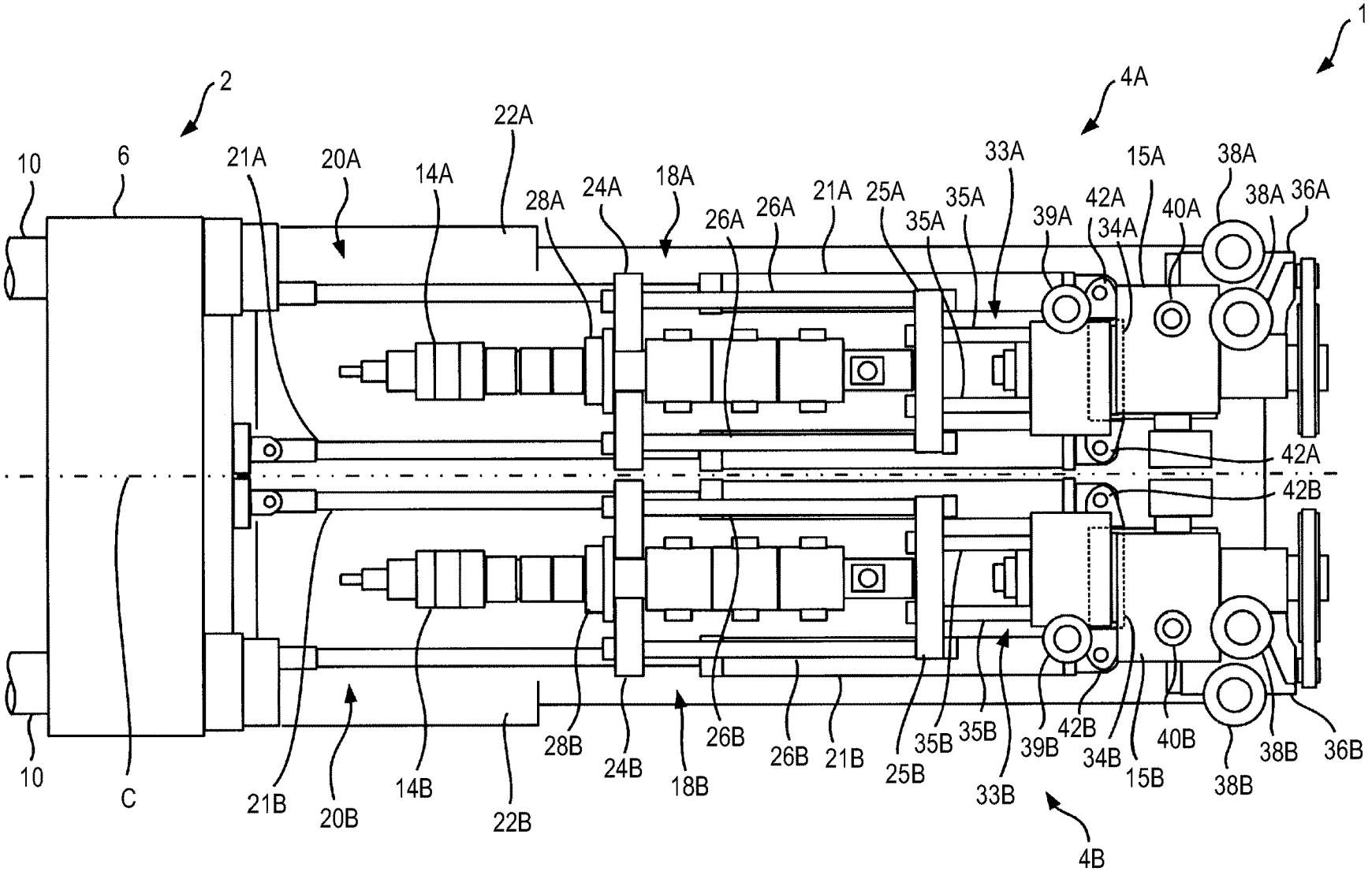
FIG. 3 is a top view showing a part of the twin injection molding machine according to the present illustrative embodiment.

FIG. 3 is an enlarged view of a part of the twin injection molding machine 1 according to the present illustrative embodiment. As described above, the first and second injection devices 4A, 4B according to the present illustrative embodiment are disposed symmetrically with respect to the machine center line C of the mold clamping device 2.

Components configuring the first and second injection devices 4A, 4B are also substantially symmetrical with respect to the machine center line C. Therefore, the first injection device 4A which is one of the injection devices will be described, and the description of the second injection device 4B will be omitted unless necessary. Each component of the first injection device 4A is denoted by a reference numeral obtained by combining a number and "A", and each equivalent component of the second injection device 4B is denoted by a reference numeral obtained by combining the same number and "B".

The first injection device 4A includes a heating cylinder 14A, a screw (not shown) in the heating cylinder 14A, and a screw driving device 15A that drives the screw. Originally, a rear end portion of the screw is connected to the screw driving device 15A and is driven by the screw driving device 15A. Then, the rear end portion of the screw is to be shown in FIG. 3. However, FIG. 3 shows a state in which the screw is separated from the screw driving device 15A and completely accommodated in the heating cylinder 14A. That is, the heating cylinder 14A and the screw can be detached from the first injection device 4A by a hoist crane for the purpose of maintenance or the like.

The first injection device 4A includes a support structure 18A and a movement mechanism 20A. The support structure 18A is a structure for supporting the heating cylinder 14A, and will be described in detail below. The movement mechanism 20A includes piston cylinder components 21A, 21A, and moves the first injection device 4A toward and away from the mold clamping device 2. The piston cylinder components 21A, 21A are characterized in attachment positions to which end portions of the piston cylinder components 21A, 21A are attached, and will be described later.

{Support Structure}

Figure 4:
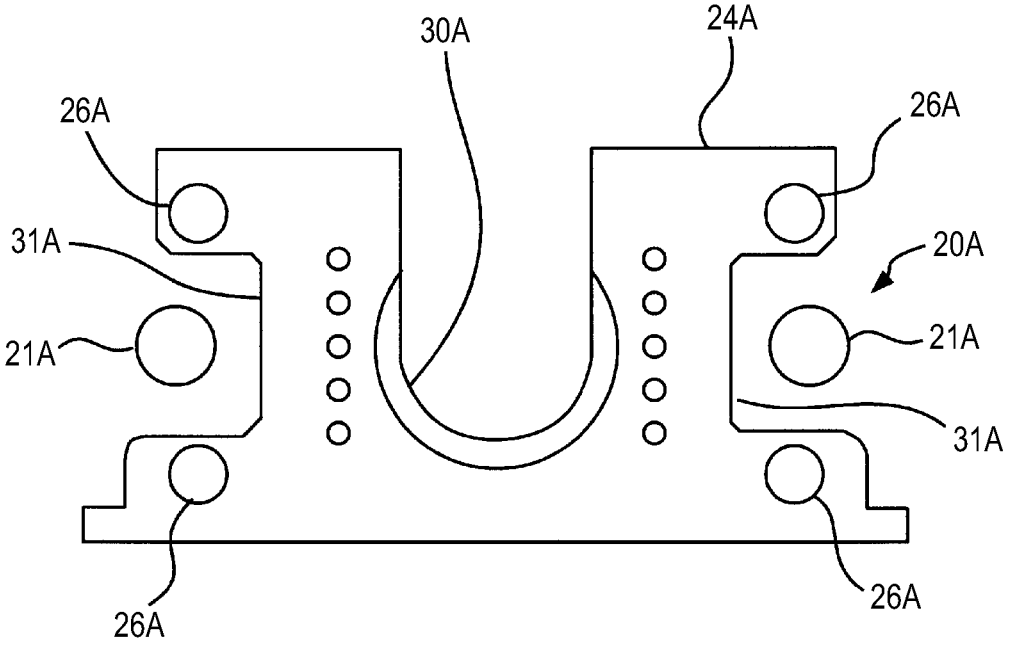
FIG. 4 is a front view showing a support plate which is a part of a support structure according to the present illustrative embodiment and which supports a heating cylinder.

In the present illustrative embodiment, the support structure 18A includes support plates including a flange plate 24A and a rear plate 25A. These support plates, that is, the flange plate 24A and the rear plate 25A are connected by a plurality of rods 26A. A flange portion 28A is formed at a center portion of the heating cylinder 14A, and the flange plate 24A fixes and supports the heating cylinder 14A at the flange portion 28A. The flange plate 24A is shown in FIG. 4, and a cylinder accommodating portion 30A formed of a substantially U-shaped groove is formed at a center of the flange plate 24A. Here, the flange portion 28A of the heating cylinder 14A (see FIG. 3) is fixed via a joint plate (not shown).

As shown in FIG. 4, the rods 26A are attached to the flange plate 24A at upper and lower sides of both left and right ends thereof. Cutouts 31A, 31A each are formed in the flange plate 24A between the two upper and lower rods 26A, 26A at the left and right ends. Then, the piston cylinder components 21A, 21A pass through the cutouts 31A, 31A. That is, each of the left and right piston cylinder components 21A is disposed between the upper and lower rods 26A. With this arrangement, a lateral width of the first injection device 4A (see FIG. 3) is small. The rear plate 25A which is the other of the support plates is similarly provided with cutouts through which the piston cylinder components 21A, 21A pass.

{Screw Driving Device}

As shown in FIG. 3, the screw driving device 15A is provided in a driving device frame 33A. The driving device frame 33A includes two plates and connecting rods 35A, 35A that connect the plates. One of the two plates is the rear plate 25A of the support structure 18A. That is, the rear plate 25A is a component of the support structure 18A and is also a plate configuring the driving device frame 33A. The other plate 34A configuring the driving device frame 33A is indicated by a dotted line in FIG. 3. The screw driving device 15A according to the present illustrative embodiment is provided in the driving device frame 33A.

The screw driving device 15A includes a driving source for rotating the screw, that is, a driving system component, and driving system components for driving the screw in an axial direction. In the screw driving device 15A according to the present illustrative embodiment, all of these driving system components are disposed on a side away from the machine center line C in the screw driving device 15A.

For example, the driving system components for rotating the screw include a screw rotation servo motor 36A. The screw rotation servo motor 36A is provided on a side away from the machine center line C in the screw driving device 15A. Further, the driving system components for driving the screw in the axial direction include a group of hydraulic accumulators. That is, the driving system components for driving the screw in the axial direction include injection accumulators 38A, 38A, an oil recovery accumulator 39A, and a pilot valve accumulator 40A. All of these components are provided on the side away from the machine center line C in the screw driving device 15A. The pilot valve accumulator 40A drives a pilot valve for controlling a flow rate of a valve to control an injection speed.

The second injection device 4B is configured similarly to the first injection device 4A, and respective components of the second injection device 4B are disposed substantially symmetrically to those of the first injection device 4A with respect to the machine center line C, as described above. That is, the driving system components in the first injection device 4A, and the driving system components in the second injection device 4B are both disposed on the side away from the machine center line C in the screw driving devices 15A, 15B. In this case, the driving system components of the first injection device 4A and the driving system components of the second injection device 4B do not interfere with each other. Therefore, the first and second injection devices 4A, 4B can be brought close to each other as much as possible. As a result, the lateral width W of the twin injection molding machine 1 (see FIG. 1) according to the present illustrative embodiment can be made small. Further, since all the driving system components are disposed at both ends of the twin injection molding machine 1, effects of facilitating the maintenance is also achieved.

{Attachment Position of Piston Cylinder Component}

One end of each of the piston cylinder components 21A, 21A configuring the movement mechanism 20A is fixed to the fixed platen 6 as shown in FIG. 3. On the other hand, the other ends of these members are not fixed to a vicinity of the rear end portion of the heating cylinder 14A, but are fixed to a fixing member further rearward than the rear end portion. Specifically, the other ends of the piston cylinder components 21A, 21A is fixed to clevis 42A, 42A as fixing members formed at a predetermined portion of the driving device frame 33A. These clevis 42A, 42A are provided on the plate 34A configuring the driving device frame 33A. That is, the driving device frame 33A may function as the fixing member. The fixing members are not limited to the clevis 42A, 42A, and may be any member as long as the piston cylinder components 21A, 21A can be fixed.

As a result of attaching the piston cylinder components 21A, 21A in this way, the piston cylinder components 21A, 21A are long, and a large stroke is secured. Therefore, in the first injection device 4A according to the present illustrative embodiment, as shown in FIG. 3, the heating cylinder 14A can be sufficiently separated from the fixed platen 6. Therefore, the heating cylinder 14A and the screw can be easily detached by a hoist crane or the like. That is, it is not necessary to turn the first injection device 4A in order to maintain the screw or the like.

{Injection Molding Machine in Related Art}

Figure 5:
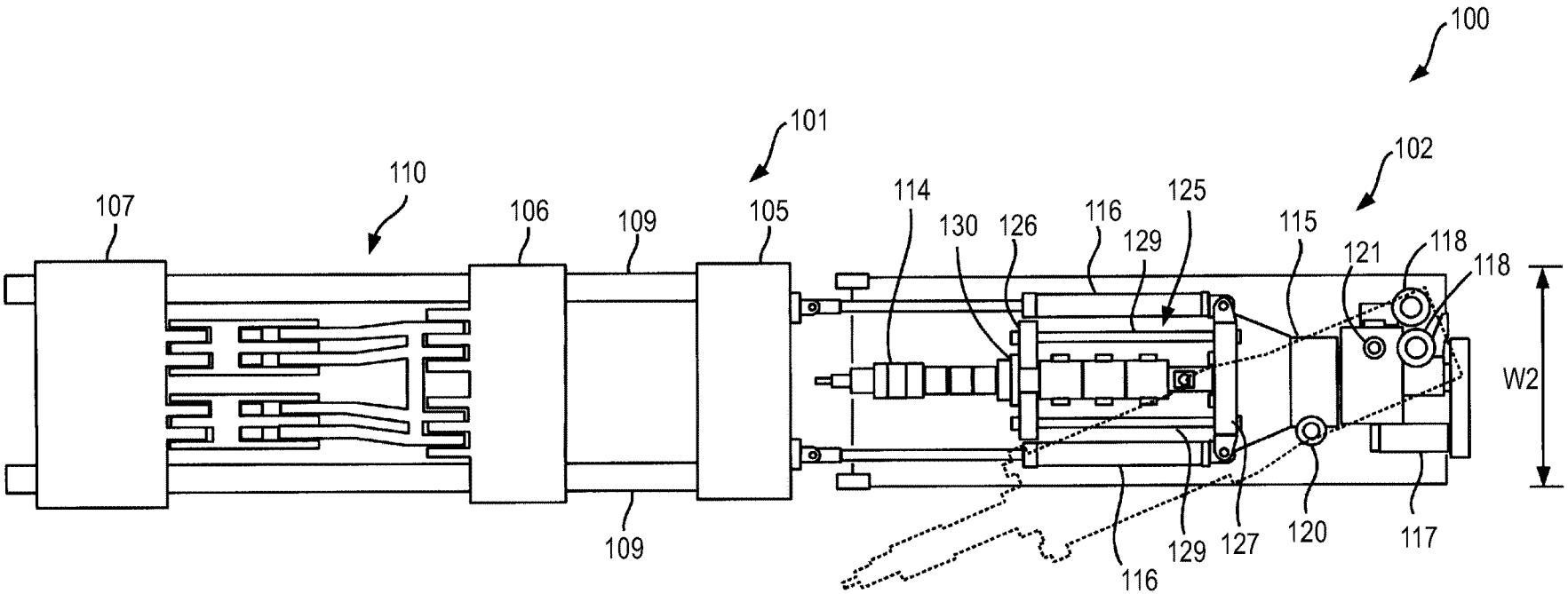
FIG. 5 Prior Art
FIG. 5 is a top view showing an injection molding machine in the related art.

The twin injection molding machine 1 according to the present disclosure is compared with an injection molding machine in the related art. FIG. 5 shows an injection molding machine 100 in the related art. The injection molding machine 100 is a metal injection molding machine, and includes a mold clamping device 101 and an injection device 102. The injection molding machine 100 in the related art includes only one injection device 102, and is different from the twin injection molding machine 1 (see FIG. 1) according to the present illustrative embodiment in the number of injection devices 102. However, since the twin injection molding machine in the related art just includes two injection devices 102 provided in the injection molding machine 100 in the related art, excellent effects of the twin injection molding machine according to the present illustrative embodiment are to be easily understood by describing a structure of the injection molding machine 100 in the related art.

The mold clamping device of the injection molding machine 100 in the related art includes a fixed platen 105, a movable platen 106, and a mold clamping housing 107. The fixed platen 105 and the mold clamping housing 107 are connected by a plurality of tie bars 109, and the movable platen 106 is slidably provided between the fixed platen 105 and the mold clamping housing 107. A toggle mechanism 110 is provided between the mold clamping housing 107 and the movable platen 106, and when the toggle mechanism 110 is bent and stretched, the mold is opened and closed.

The injection device 102 of the injection molding machine 100 in the related art includes a heating cylinder 114, a screw (not shown) in the heating cylinder 114, and a screw driving device 115 for driving the screw. Further, a support structure 125 that supports the heating cylinder 114, and piston cylinder components 116, 116 that are movement mechanisms for driving the injection device 102 in a direction of approaching or being separated from the fixed platen 105 are provided.

{Driving System Component}

The screw driving device 115 is provided with a plurality of driving system components. First, a servo motor 117 for rotationally driving the screw is provided. Next, a group of hydraulic accumulators for driving the screw in the axial direction, that is, injection accumulators 118, 118, an oil recovery accumulator 120, and a pilot valve accumulator 121 are provided. In the screw driving device 115, these driving system components are disposed as follows. First, the servo motor 117 and the oil recovery accumulator 120 are provided on one side, and the injection accumulators 118, 118 and the pilot valve accumulator 121 are provided on the other side. Therefore, when the two injection devices 102 are disposed in parallel, the driving system components interfere with each other, so that the injection devices 102 cannot be sufficiently brought close to each other. That is, a lateral width W2 of the injection molding machine 100 increases.

{Support Structure}

The support structure 125 that supports the heating cylinder 114 of the injection molding machine 100 in the related art includes a flange plate 126, a rear plate 127, and a plurality of rods 129 that connect the flange plate 126 and the rear plate 127. A rear end portion of the heating cylinder 114 is fixed to the rear plate 127, and a flange portion 130 formed at a center portion of the heating cylinder 114 is fixed to the flange plate 126.

Figure 6:
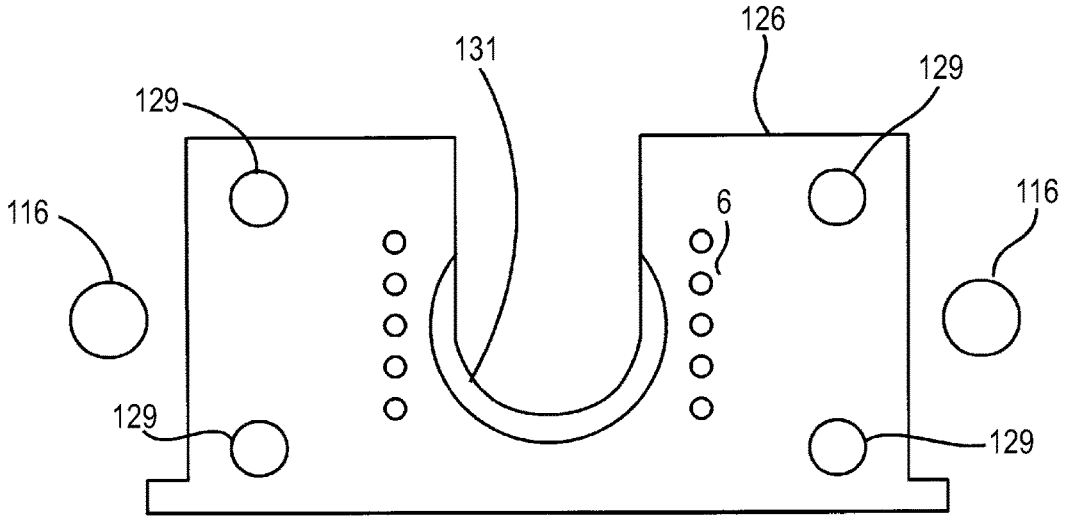
FIG. 6 Prior Art
FIG. 6 is a front view showing a support plate which is a part of a support structure in the related art and which supports a heating cylinder.

FIG. 6 shows the flange plate 126 in the related art. The flange plate 126 has a substantially rectangular shape, and a cylinder accommodating portion 131 formed of a substantially U-shaped groove is formed in a center of the flange plate 126. Here, a flange portion 130 of the heating cylinder 114 (see FIG. 5) is fixed via a joint plate (not shown). Then, the rods 129 are attached to the flange plate 126 at upper and lower sides of both left and right ends thereof. Since the flange plate 126 in the related art is not provided with cutouts at both left and right end portions thereof, the piston cylinder components 116, 116 are disposed outside the flange plate 126. Since a distance between the two piston cylinder components 116, 116 is large, the lateral width W2 of the injection device 102 of the injection molding machine 100 in the related art (see FIG. 5) is large. If the two injection devices 102 are arranged adjacently, the lateral width W2 increases.

{Movement Mechanism in Related Art}

As shown in FIG. 5, one ends of the piston cylinder components 116, which configure the movement mechanism in the related art, are provided on the fixed platen 105, and the other ends are provided on the rear plate 127 of the support structure 125. That is, the other ends of the piston cylinder components 116, 116 are provided in a vicinity of the rear end portion of the heating cylinder 114. That is, a length of the piston cylinder component 116 is relatively short, and a stroke of movement is short. Therefore, when the heating cylinder 114 and the like is maintained, it is necessary to turn the injection device 102 as indicated by a dotted line in FIG. 5. This is different from the twin injection molding machine 1 (see FIG. 1) according to the present illustrative embodiment.

{Twin Injection Molding Machine According to Second Illustrative Embodiment}

Figure 7:
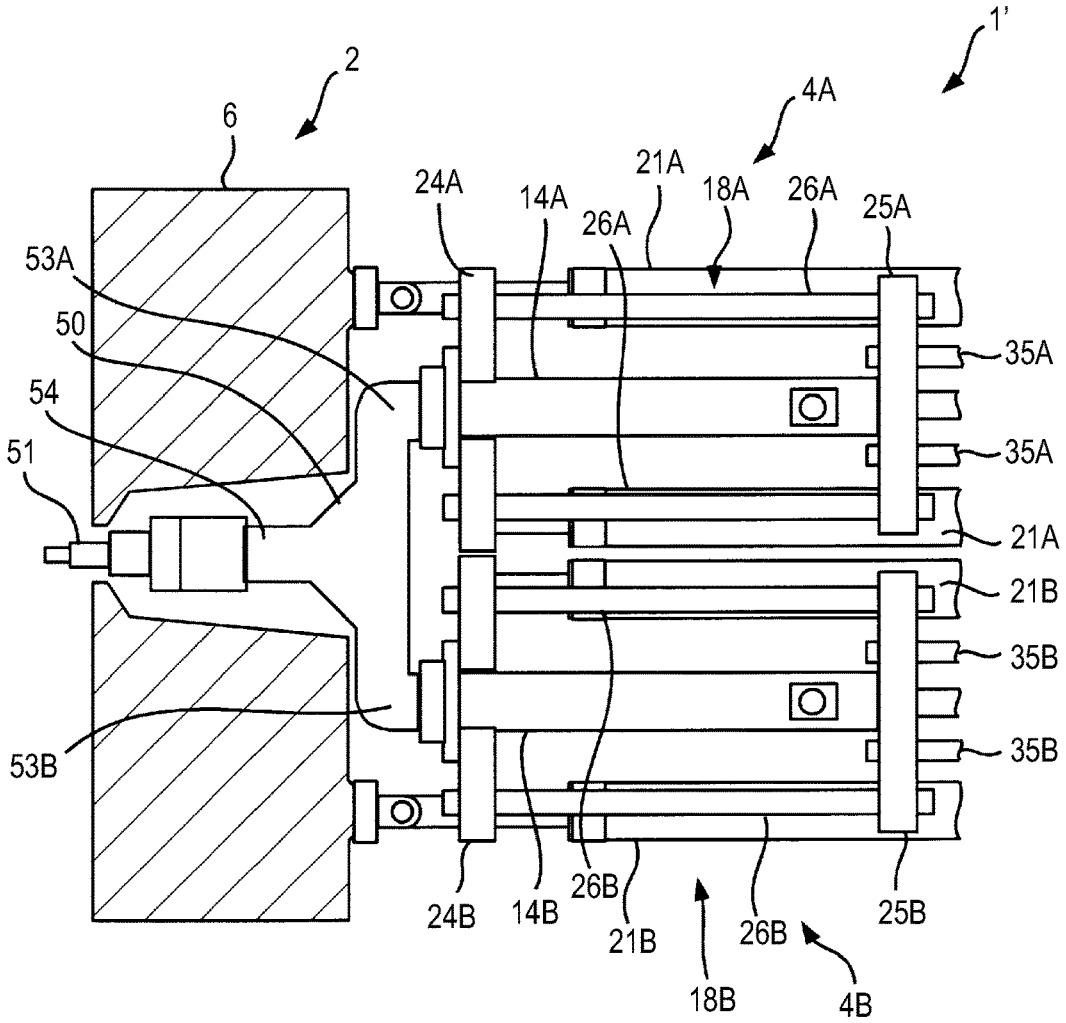
FIG. 7 is a top view showing a part of a twin injection molding machine according to a second illustrative embodiment of the present disclosure.

The twin injection molding machine 1 (see FIG. 1) according to the present illustrative embodiment can be variously modified. For example, a modification can be made such that injection materials injected from the first and second injection devices 4A, 4B are merged and injected. FIG. 7 shows a twin injection molding machine 1' according to a second illustrative embodiment including a merging adapter 50 and a common injection nozzle 51. Components having the same functions as those described in the twin injection molding machine 1 (see FIG. 1) according to the previous illustrative embodiment will not be described, and will be denoted by the same reference numerals.

{Merging Adapter}

As shown in FIG. 7, the merging adapter 50 includes two flow path inlets 53A, 53B and one flow path outlet 54. The heating cylinders 14A, 14B of the first and second injection devices 4A, 4B are connected to the two flow path inlets 53A, 53B respectively, and the common injection nozzle 51 is provided at the flow path outlet 54. Therefore, when the injection materials are injected in the first and second injection devices 4A, 4B, the injection materials are merged and injected from the common injection nozzle 51.

{Twin Injection Molding Machine According to Third Illustrative Embodiment}

Figure 8:
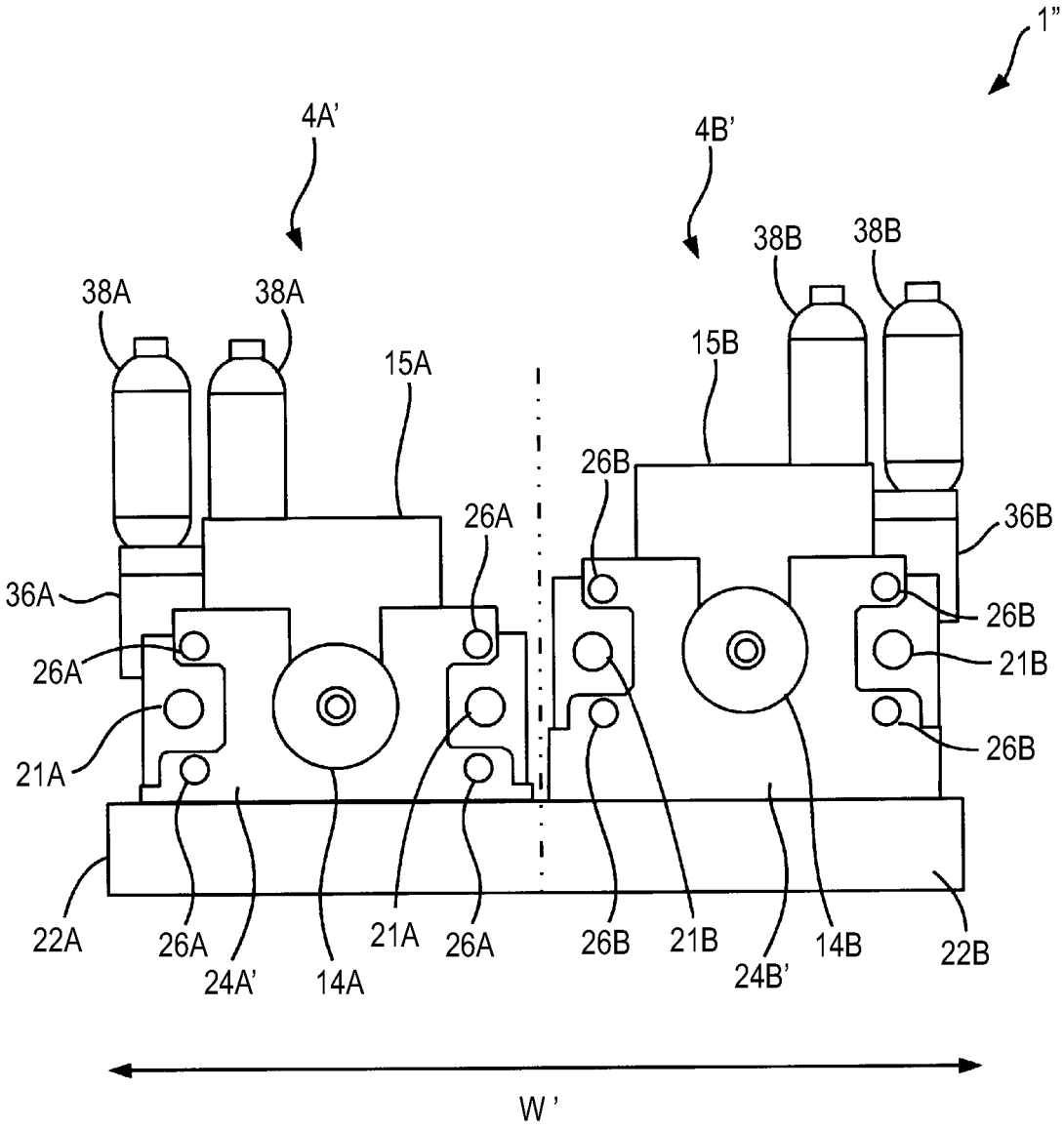
FIG. 8 is a front view showing first and second injection devices in a twin injection molding machine according to a third illustrative embodiment of the present disclosure.

FIG. 8 shows a part of a twin injection molding machine 1" according to a third illustrative embodiment. Specifically, a front view of first and second injection devices 4A', 4B' is shown. In the illustrative embodiment, flange plates 24A', 24B' are different in height from each other. As a result, heights of the heating cylinders 14A, 14B in the first and second injection devices 4A', 4B' are different from each other. However, the heating cylinders 14A, 14B are disposed substantially symmetrically with respect to the machine center line C. Thus, even when the first and second injection devices 4A', 4B' are displaced in a height direction, a lateral width W' of the twin injection molding machine 1" can be reduced.

{Other Modifications}

In the twin injection molding machine 1 (see FIG. 1) according to the present illustrative embodiment, the first and second injection devices 4A, 4B are disposed in parallel. A modification can be made. Specifically, the first and second injection devices 4A, 4B are displaced from each other with an angle therebetween such that front ends of the heating cylinders 14A, 14B are close to each other and the screw driving devices 15A, 15B are slightly separated from each other. Other modifications can also be made. In the twin injection molding machine 1 according to the present illustrative embodiment, a mold clamping mechanism of the mold clamping device 2 includes the toggle mechanism 12, but a direct pressure type mold clamping mechanism can be adopted.

The injection device 4A which is one of the injection devices has been described, since components configuring the first and second injection devices 4A, 4B are substantially symmetrical with respect to the machine center line C. Each component of the second injection device 4B is denoted by a reference numeral obtained by combining the same number as that of the first injection device 4A and "B". That is, the second injection device 4B includes the heating cylinder 14B, the screw driving device 15B, a support structure 18B, a movement mechanism 20B, a piston cylinder component 21B, the bed 22B, the flange plate 24B, a rear plate 25B, a rod 26B, a flange portion 28B, a cylinder accommodating portion 30B, a cutout 31B, a driving device frame 33B, a connecting rod 35B, a screw rotation servo motor 36B, an injection accumulator 38B, an oil recovery accumulator 39B, a pilot valve accumulator 40B, and a clevis 42B.

Although the present invention made by the present inventors has been specifically described based on the illustrative embodiments, it is needless to say that the present invention is not limited to the illustrative embodiments described above, and various modifications can be made without departing from the scope of the present invention. A plurality of examples described above can be implemented in combination as appropriate.

What is claimed is:

1. A twin injection molding machine comprising:

a mold clamping device configured to clamp a mold, the mold clamping device comprising a fixed platen, a mold clamping housing, and a movable platen movable between the fixed platen and the mold clamping housing; and first and second injection devices each comprising:

a heating cylinder;

a screw disposed in the heating cylinder; and a screw driving device comprising driving system components and configured to drive the screw, wherein the first and second injection devices are disposed symmetrically with respect to a machine center line of the mold clamping device, wherein the driving system components provided in the screw driving device of the first injection device and the driving system components provided in the screw driving device of the second injection device are each disposed on the outward side of each respective injection device corresponding to a side away from the machine center line in the respective screw driving devices, the driving system components being configured to drive the screw of each the first and second injection devices in an axial direction of the first and second injection devices and rotate the screw of each the first and second injection devices, and wherein the twin injection molding machine further comprises:

a first bed on which the first injection device is mounted; and a second bed on which the second injection device is mounted, the first bed and the second bed being separable from each other, wherein the first and second injection devices each comprise a movement mechanism configured to move the respective one of the first and second injection devices in a direction of approaching or being separated from the mold clamping device, wherein each movement mechanism comprises a piston cylinder component, wherein a first end portion of each piston cylinder component is fixed to the fixed platen and a second end portion of each piston cylinder component is fixed to a fixing member positioned further rearward than a rear end portion of the heating cylinder of each of the first and second injection devices, the fixing member being a frame of the screw driving device of each of the first and second injection devices, and wherein the driving system components of each of the first driving device and the second driving device comprises a plurality of hydraulic accumulators on the outer side of each respective injection device corresponding to the side away from the machine center line in the respective screw driving devices and configured to drive the screw of each the first and second injection devices in the axial direction of the first and second injection devices.

2. The twin injection molding machine according to claim 1, wherein the driving system components each comprises an electric motor configured to rotate the screw of each the first and second injection devices.

3. The twin injection molding machine according to claim 1, wherein each of the first and second injection devices comprises a support structure configured to support the respective heating cylinder, wherein the support structure comprises a support plate that supports the heating cylinder, and wherein the support plate has a cutout for passing the piston cylinder component.

4. The twin injection molding machine according to claim 3, wherein the support plate comprises:

a rear plate that supports a rear end portion of the heating cylinder; and a flange plate that supports a center portion of the heating cylinder, and wherein the support structure comprises a plurality of rods connecting the rear plate and the flange plate.

5. The twin injection molding machine according to claim 4, wherein the flange plate has a U-shaped groove formed in a center of the flange plate.

6. The twin injection molding machine according to claim 1, further comprising:

a merging adapter, wherein the merging adapter is connected to the first and second injection devices and has one injection nozzle, and injection materials from the first and second injection devices are merged and injected from said one injection nozzle.

7. The twin injection molding machine according to claim 1, wherein the first and second injection devices are configured to inject metal as injection materials.

8. The twin injection molding machine according to claim 1, wherein the plurality of hydraulic accumulators of each of the first driving device and the second driving device comprises a plurality of injection accumulators.

9. The twin injection molding machine according to claim 8, wherein the plurality of hydraulic accumulators of each of the first driving device and the second driving device further comprises an oil recover accumulator and a pilot valve accumulator.

10. The twin injection molding machine according to claim 1, wherein the driving system components each comprises a screw rotation servo motor disposed on the outer side of each respective injection device corresponding to the side away from the machine center line in the respective screw driving devices and configured to rotate the respective screws.

* * * * *